US006684640B2

(12) United States Patent
McMillan et al.

(10) Patent No.: US 6,684,640 B2
(45) Date of Patent: Feb. 3, 2004

(54) GAS TURBINE ENGINE COMBUSTION SYSTEM

(75) Inventors: Robin Thomas David McMillan, Bardney (GB); Martin Paul Brown, West des Moines, IA (US); Sarah Gillian Dawson, Dublin (IE)

(73) Assignee: Alstom Power N.V., Amsterdam (NL)

( * ) Notice: Subject to any disclaimer, the term of this patent is extended or adjusted under 35 U.S.C. 154(b) by 95 days.

(21) Appl. No.: 10/036,101

(22) Filed: Oct. 22, 2001

(65) Prior Publication Data

US 2002/0112480 A1 Aug. 22, 2002

(30) Foreign Application Priority Data

Oct. 23, 2000 (GB) ..... 0025878

(51) Int. Cl.[7] ..... F23R 3/14
(52) U.S. Cl. ..... 60/737; 60/748
(58) Field of Search ..... 60/737, 748; 239/399, 239/403, 404

(56) References Cited

U.S. PATENT DOCUMENTS 1,731,722 A * 10/1929 Meier ..... 239/404
5,169,302 A 12/1992 Keller
5,307,634 A * 5/1994 Hu ..... 60/737
5,479,781 A 1/1996 Fric et al.
5,588,824 A 12/1996 McMillan
5,611,684 A * 3/1997 Spielman ..... 60/737
5,674,066 A 10/1997 Hausermann et al.
6,155,820 A 12/2000 Dobbeling et al.
6,216,466 B1 * 4/2001 Alkabie ..... 60/746

FOREIGN PATENT DOCUMENTS

EP 0 762 057 A1 3/1997
EP 0 918 191 A1 5/1999
EP 0957 311 A2 11/1999
JP 02-033418 * 2/1990

* cited by examiner

*Primary Examiner*—Ted Kim
(74) *Attorney, Agent, or Firm*—Kirschstein, et al.

(57) ABSTRACT

A gas-fuelled burner, especially for gas turbines powered by low calorific value fuel, is provided with restrictors to slow the incoming fuel from inlets to a similar mass mean velocity as the air provided through inlets, thereby reducing turbulence and improving combustion. The restrictors and outlet passages carrying the fuel to the combustion pre-chamber are located in vanes of a radial inlet swirler so as to alternate with the air inlets. The geometry is such that the respective flows emerge tangentially to a notional circle centered on the combustion pre-chamber of the turbine. The circle is preferably between 0.7 and 1.0 times the diameter of the actual pre-chamber. The ratio of the area of the restrictor to that of the outlet passage may lie between 1:1.1 and 1:1.7, preferably 1:1.4.

16 Claims, 3 Drawing Sheets

GAS TURBINE ENGINE COMBUSTION SYSTEM

FIELD OF THE INVENTION

The invention is concerned with a gas turbine engine combustion system and with means for mixing fuel and air in a gas-fuelled engine, particularly gas turbine engines using gas fuel of low calorific value.

BACKGROUND OF THE INVENTION

Fuel-air mixing means (burners) to provide the combustible medium for gas turbine engine operation take many and varied forms according to manufacturer preference. A manufacturer may become expert in a particular burner type and wherever possible will adapt that type of burner to suit the engine duty, for example to burn unusual or particular kinds of fuel.

The present applicant has already devised a combustion system which incorporates a burner of the radial inflow swirler type. It is sometimes desirable to able to burn a fuel gas of low calorific value (LCV fuel), from say a coal gasification process. Difficulties in the use of such fuel include the volume of fuel required for a given power output being comparatively large in relation to the volume of air when compared to, for example, high calorific value (HCV) liquid fuels. Between these extremes, there are significant differences in respect of, among other things, fuel injection position, direction of flow and flow rates in order to achieve best mixing of air and fuel. Also, where an LCV fuel has a relatively high flame speed, flame speed being the rate at which a flame will propagate in a mixture (which is fast for example where it contains a high proportion of hydrogen), there is higher risk of fuel pre-ignition. When this occurs in parts of the burner not intended to accept a flame, damage may be caused to components of the burner.

Burner designs which encourage small regions of re-circulating air/fuel mixture to form in proximity to a burner component surface may be harmful because a flame may become stabilized in such a region, being effectively static. It may then attach itself to the burner surface and burn it away.

It will be understood by the skilled person that LCV fuel being of low calorific value may comprise in the region of 20–60% of the air-fuel volume in order to achieve required engine power. Plainly, introducing large amounts of fuel into an inflow swirler system presents quite different problems to that of HCV fuels where lower volumes are more usually applied to such systems.

There are two main options open to the skilled person to achieve the correct volume of fuel for mixing with air. Either the fuel must be injected through small openings at relatively high pressure into the air-stream or it may be injected through large openings at relatively low pressure. While high pressure flow through small openings may be typical for HCV fuels, low pressure flow through large openings is untypical.

It has been found that injecting large amounts of fuel through small openings at higher pressure induces turbulence in the air/gas stream and this is especially so where the fuel is injected at some angle to the air-stream. Whereas this may be advantageous when dealing with low volume, high calorific value HCV fuels (where it may promote better mixing), it is found detrimental for LCV fuels and especially so where such fuels have relatively high flame speed. As already mentioned, in such cases a flame may become established in a re-circulation region (effectively a static region) and then attach itself to an edge of the swirler hardware, for example at the trailing edges of vanes. Should this happen, the flame may eventually burn away the metal.

In addition to difficulties associated with specific fuels, all new gas turbine combustion systems must meet ever more restrictive environmental pollution standards in relation to combustion exhaust products discharged to atmosphere.

SUMMARY OF THE INVENTION

It is therefore an aim of the preferred implementation of the present invention to provide a burner of the radial swirler inflow type which satisfactorily mixes LCV type gas fuels with air to enable controlled combustion in a downstream combustion chamber and which results in engine exhaust pollution levels, in particular CO, within acceptable limits.

Accordingly, in order to overcome the problems associated with known burners, the present invention provides, in one aspect, a gas turbine engine combustion system, comprising in flow sequence a radial inflow swirler for mixing gaseous fuel and air, a combustion pre-chamber and a combustion main chamber, the swirler, the pre-chamber and the main chamber having a common longitudinal axis, the swirler comprising air and gas fuel passages angularly arrayed around the pre-chamber, the passages being oriented tangentially to a notional circle centered on the common longitudinal axis, thereby in operation to impart a common swirling motion to streams of fuel and air as they enter the pre-chamber from the passages, each gas outlet passage having an exit situated immediately downstream of an exit of an air supply passage with respect to the direction of swirl and being sized relative to the air supply passage such that at least at a predetermined power condition of the engine, the mass mean velocity of the gas- and air-streams at said notional circle are closely matched to each other.

Each gas fuel passage preferably includes means for restricting the fuel flow. The restricting means may comprise a narrow, i.e., reduced cross-section, portion of the fuel passageway, preferably at the entrance to the fuel passageway.

The ratio of the area of the restricted or narrow portion of the fuel passageway to the remainder of the passageway may be in the range from 1:1.1 to 1:1.7 and is preferably 1:1.4.

The passageways are preferably at an inclined angle to radii of the swirler so that the passageways emerge at the radially inner ends tangentially to a notional circle centered on the same axis as a combustion pre-chamber located downstream of the mixing means. The diameter of the notional circle is preferably between 0.7 and 1.0 times the diameter of the combustion pre-chamber.

In a second aspect of the invention, there is provided fuel/air mixing means for incorporation in the burner of a gas-fuelled engine, the mixing means comprising fuel passageways and air passageways for introducing fuel and air to a combustion chamber from a radially outer position to a radially inner position relative to an axis concentric with the combustion chamber, each gas fuel passageway having an exit situated immediately downstream of an exit of an air passageway with respect to a direction of swirl of the fuel and air in the combustion chamber, the radially inner ends of said passageways being substantially tangential to a notional circle centred on the same axis as said chamber. Again, the gas fuel passageways are preferably sized relative to the air passageways such that at least at a predetermined power condition of the engine, the mass mean velocity of the fuel and air at said notional circle are closely matched to each other.

The fuel and air passageways preferably alternate circumferentially around said axis. The passageways are also preferably disposed at inclined angles to radii of a radial swirler inflow type mixing means.

In one embodiment of the invention, each fuel gas passageway includes means for smoothing the flow of the gas. The smoothing means also acts as a restrictor and may comprise a plate extending across the passageway and having a plurality of apertures therethrough. The apertures are suitably circular, although other shapes may alternatively be employed, and they may be arranged in a grid pattern or randomly. Twelve apertures are suitably provided in each plate, although more or fewer apertures may be used. The plates are conveniently located in opposed grooves in the side walls of each passageway at a position intermediate the ends thereof. While it may be desirable to secure the plates in position permanently, for example by welding, it may alternatively be convenient for the plates to be mounted in the grooves removable, to permit their replacement with plates of an alternative configuration in the event of a change of fuel gas, for example.

The invention also comprehends a gas-fuelled gas turbine engine comprising fuel/air mixing means as set out in any of the preceding paragraphs.

BRIEF DESCRIPTION OF THE DRAWINGS

The invention will be described by reference to the following drawings, in which.

DETAILED DESCRIPTION OF THE ILLUSTRATED EMBODIMENTS

Figure 1:
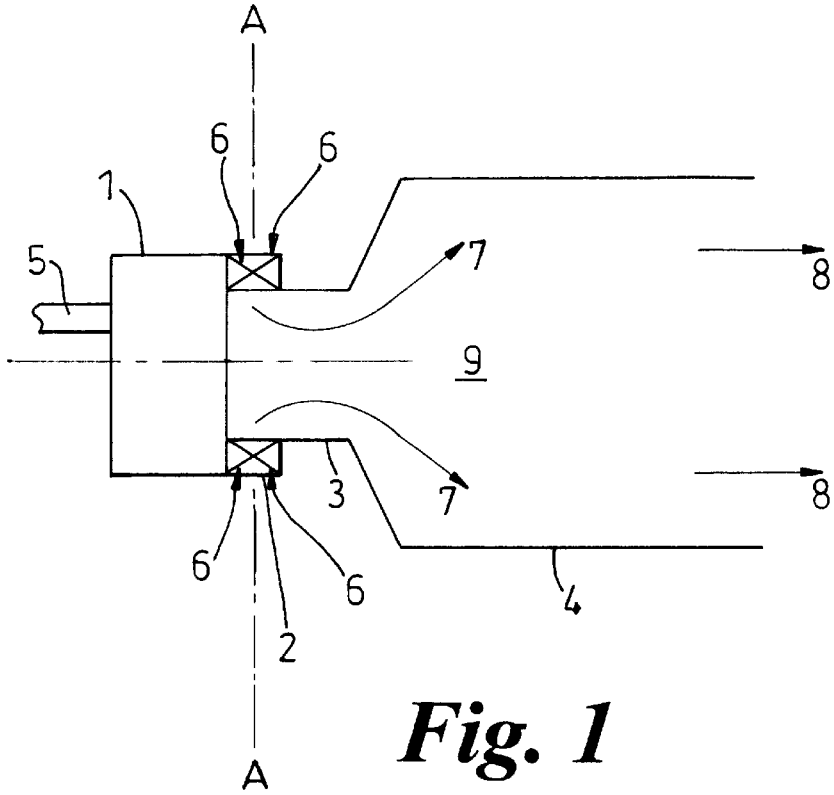
FIG. 1 shows a section through a burner and combustion chamber assembly fitted with an inflow swirler of the type utilized by the invention.

FIG. 1 illustrates a section through a known type of burner and combustion chamber assembly for a gas turbine engine, where burner head 1 with air/fuel mixing swirler 2 is attached to the upstream end of a combustion chamber comprising in flow series a combustion pre-chamber 3 and a combustion main chamber 4. It will be seen that the pre-chamber 3 is of appreciably smaller diameter and cross-sectional area than the main chamber 4, and there is a short transition region where the chamber diameter flares outwardly from the pre-chamber to the main chamber. A conduit 5 is provided for LCV gas fuel supply to the burner. Arrows 6, 7 and 8 respectively indicate the direction of air flow to the burner swirler inlet, the fuel-air mixture for combustion and the combustion products themselves, which products pass through the engine turbine section downstream (not shown) to do work and then are exhausted to atmosphere. The main combustion region within the combustion chamber is indicated at 9.

Figure 2:
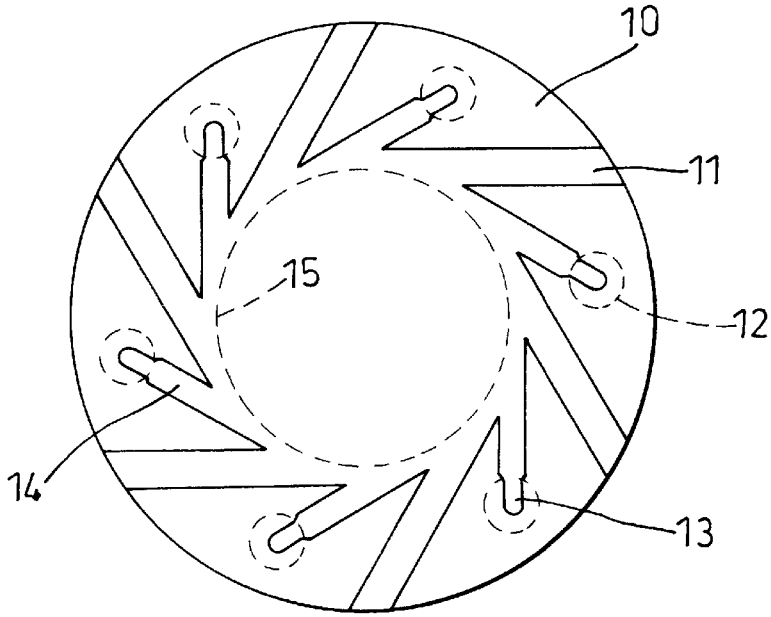
FIG. 2 is an enlarged view on section A—A of FIG. 1, showing a swirler according to the invention in more detail.

In the enlarged view on section A—A of FIG. 1 shown in FIG. 2, the swirler element 2 includes a plurality of swirler vanes 10, six such vanes being shown for purposes of illustration. Air supply passages 11 are defined between adjacent vanes and the inflowing air passes through these to enter the pre-chamber at it's the outer periphery. Each vane 10 is formed with a fuel outlet passage 14, a restriction 13, which in this embodiment comprises a portion of passage having a narrower width than fuel outlet passage 14, and an LCV fuel gas port 12 (shown as a dashed circle), which is connected to conduit 5 through a gallery or other form of connection within burner head 1 (FIG. 1). The fuel passages 14 formed in the vanes 10 and the air passages 11 formed between the vanes extend inwardly from the outer periphery of the swirler at inclined angles compared to the radial direction of the swirler. As a result, the outlet ends of both sets of passages emerge at a radially inner portion of the swirler so as to lie tangentially to a notional circle 15 (shown dashed) concentric with the swirler and pre-chamber. Hence, the air and fuel enter the pre-chamber with a swirling motion about its longitudinal centerline, which encourages good fuel-air mixing and helps to stabilize combustion in the main chamber.

It may be convenient to note at this point that "radial inflow swirler" is a term of art which includes swirlers of this type, since the air and fuel inflows through the swirler passages have components of velocity in the radial direction.

Figure 3:
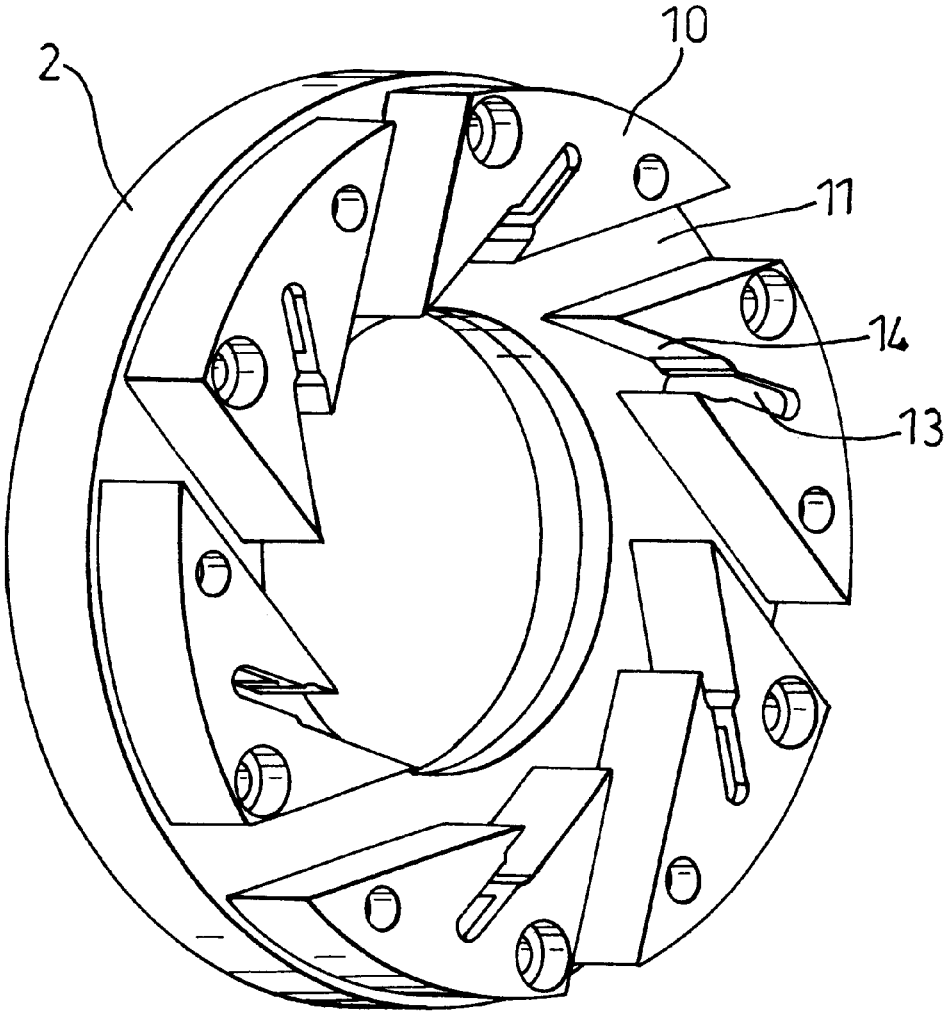
FIG. 3 is a perspective end view of the swirler of FIG. 2.

The details of the swirler 2, with its vanes 10 and passages 11 and 14, are more clearly visible in the perspective view of the swirler element shown in FIG. 3.

In operation, the LCV gas fuel flows under pressure through ports 12, shown in dotted lines (FIG. 2), enters fuel outlet passages 14 through restrictions 13, and exits from passage 14 into the air-stream emerging from the air passage 11. Mixing of fuel and air begins at this point and continues as the mixture progresses downstream so that a thorough mix is achieved by the time it reaches the main combustion zone 9.

It will be seen from FIGS. 2 and 3 that the shared tangential orientation of the air and fuel passages 11, 14 is such that an anti-clockwise swirling motion is imparted to the respective gaseous streams as they enter the pre-chamber 3, and it may be said that with respect to the direction of swirl, each gas outlet passage 14 is situated immediately downstream of the exit of an air supply passage 11. It will also be seen that the tangential orientation of the passages will cause the fuel gas streams to be introduced to the air streams at a shallow angle. In itself this is beneficial for facilitating achievement of a desired objective of the invention, which is that, at least for the power condition at which the gas turbine engine will operate for most of the time, the streams of LCV gas fuel are introduced to the air-streams in such a way that least turbulence is created. In order to further facilitate this, both the mass flow and velocity of the gas- and air-streams at the notional circle 15 are as closely matched as possible at the relevant power condition, within limits. Usually, the relevant power condition will be full load, and in this case the restriction 13 is sized small enough to minimize acoustic coupling between the gas supply system and the burner, yet at the same time is large enough to allow sufficient fuel volume to meet the engine's needs at full load with minimum disruption to burner air-stream flow.

The function of the fuel outlet passage 14 is to condition the gas fuel stream. It is orientated, and sized relative to the restriction 13 and air-stream passage sizes such that the fuel-stream at the exit of outlet passage 14 has a similar mass mean velocity to that of the air-stream at the exit of passage 11. Thus, substantially equal mass mean velocities are achieved between the fuel and the air with minimal turbulence being created. With regard to sizing of the area of the fuel restriction 13 in relation to that of the outlet passage 14, a ratio of 1:1.4 is found to be particularly effective but a range of between 1:1.1 and 1:1.7 gives beneficial results where the restrictor is sized to suit engine full power requirement.

For compatible fuel/air velocities the angular relationship between adjacent air and fuel passages 11, 14 is important. Further, it is found for optimum results in mixing and combustion that there is a relationship between the position of the fuel/air passages and the diameter of the combustion pre-chamber. Accordingly, the air and fuel flow passage center lines are preferably arranged tangential to the notional circle 15, which is concentric with the longitudinal central axis of the combustion pre-chamber and of a diameter falling within the range of 0.7–1.0 times that of the pre-chamber diameter.

Figure 4:
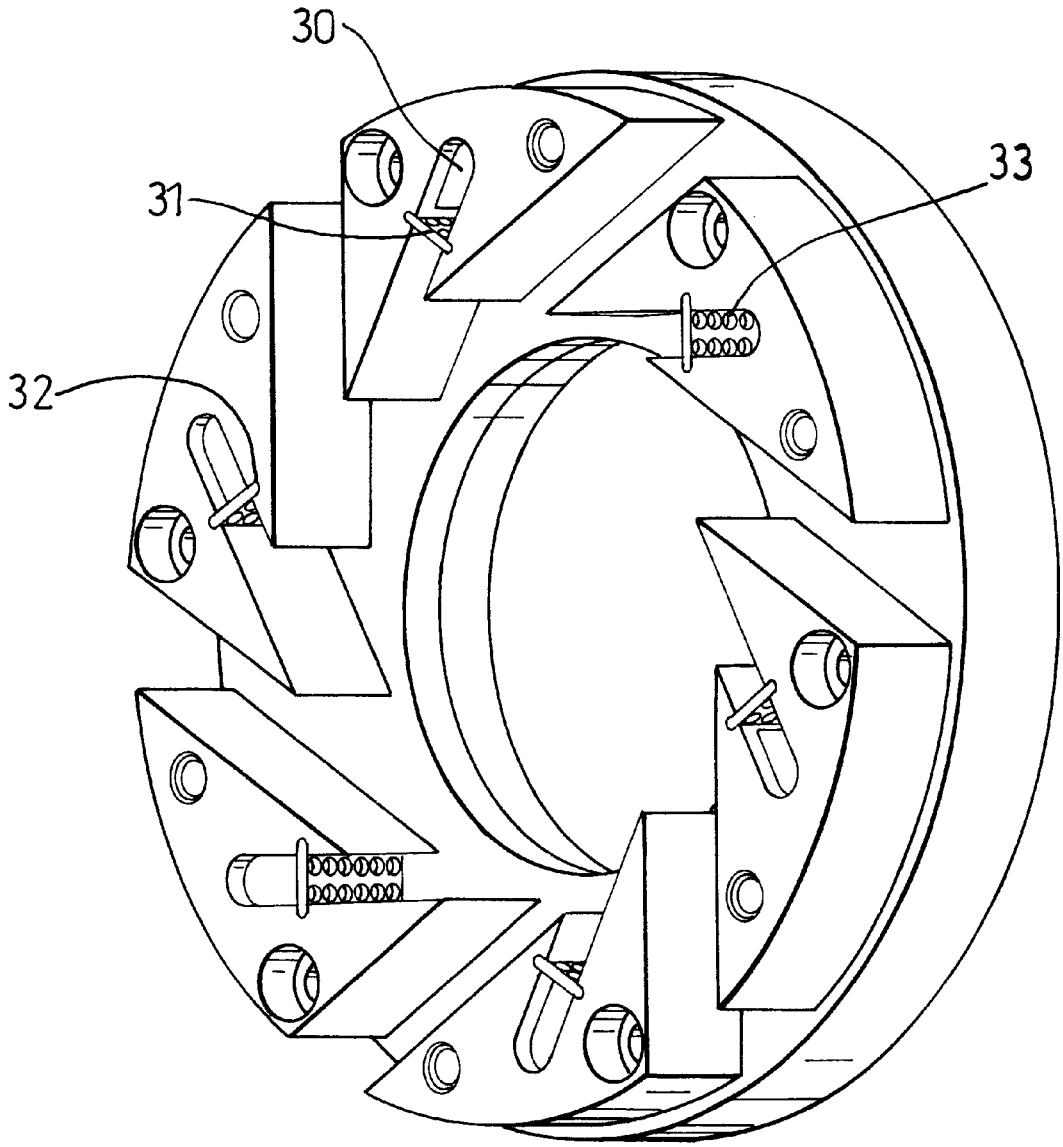
FIG. 4 is a perspective view of a swirler according to an alternative embodiment of the invention.

Referring now to FIG. 4, a modified form of the swirler shown in FIG. 3 comprises fuel passageways 30 of uniform width, but each is provided with a flow smoothing device 31 consisting of a flat plate located in opposed grooves 32 in the sides of the passageway and having a plurality (for example as illustrated, twelve) holes 33 therethrough which serve to reduce any turbulence induced in the fuel flow as a result of the sudden change in flow direction as the fuel gas enters from the entry ports.

While the embodiment here described shows six air passages and six fuel passages alternately arranged and equally spaced, the invention is clearly not limited to these specific numbers since the principles can be applied to any number of vanes and associated air and fuel passages.

We claim:

1. A gas turbine engine combustion system, comprising: a radial inflow swirler for mixing gaseous fuel and air, a combustion pre-chamber and a combustion main chamber, the swirler, the pre-chamber and the main chamber having a common longitudinal axis and being arranged in a flow sequence, the swirler comprising air and gas fuel passages angularly arrayed around the pre-chamber, the passages being oriented tangentially to a notional circle centered on the common longitudinal axis, thereby in operation to impart a common swirling motion to streams of fuel and air as they enter the pre-chamber from the passages, each gas fuel passage having an exit situated immediately downstream of an exit of an air supply passage with respect to a direction of swirl and being sized relative to the air supply passage such that at least at a predetermined power condition of the gas turbine engine, a mass mean velocity of the fuel and air streams at said notional circle are closely matched to each other.

2. The combustion system according to claim 1, wherein each gas fuel passage comprises means for restricting the flow of fuel.

3. The combustion system according to claim 2, wherein the restricting means comprises a reduced cross-section portion of the gas fuel passage.

4. The combustion system according to claim 3, wherein the reduced cross-section portion is located at an entrance to the gas fuel passage.

5. The combustion system according to claim 2, wherein a ratio of an area of the restricting means to a remainder of the passage is from 1:1.1 to 1:1.7.

6. The combustion system according to claim 5, wherein the ratio of the area of the restricting means to the remainder of the passage is 1:1.4.

7. The combustion system according to claim 2, wherein the restricting means comprises smoothing means extending across the passage to smooth the flow of the gas passing therealong.

8. The combustion system according to claim 7, wherein the smoothing means comprises a plate having a plurality of apertures therethrough.

9. The combustion system according to claim 8, wherein the plate has an array of circular holes therethrough.

10. The combustion system according to claim 9, wherein the plate has twelve holes therethrough.

11. The combustion system according to claim 1, wherein the notional circle has a diameter which lies between 0.7 and 1.0 times a diameter of the combustion pre-chamber.

12. The combustion system according to claim 1, wherein the fuel is a fuel gas of low calorific value.

13. A fuel/air mixing system for incorporation in a burner of a gas-fueled engine, the mixing system comprising: fuel passageways and air passageways for introducing fuel and air to a combustion chamber from a radially outer position to a radially inner position relative to an axis concentric with the combustion chamber, each fuel passageway having an exit situated immediately downstream of an exit of an air passageway with respect to a direction of swirl of the fuel and air in the combustion chamber, said passageways having radially inner ends which are substantially tangential to a notional circle centered on the same axis as said chamber, the fuel passageways being sized relative to the air passageways such that at least at a predetermined power condition of the engine, a mass mean velocity of the fuel and air at said notional circle are closely matched to each other.

14. The fuel/air mixing system according to claim 13, the fuel and air passageways alternate circumferentially around said axis.

15. The fuel/air mixing system according to claim 13, and further comprising a radial inflow swirler, wherein the fuel and air passageways are disposed at inclined angles relative to radii of said swirler.

16. The fuel/air mixing system according to claim 13, wherein the fuel is a fuel gas of low calorific value.

* * * * *